US012421878B2

(12) United States Patent
Radulescu

(10) Patent No.: US 12,421,878 B2
(45) Date of Patent: Sep. 23, 2025

(54) ROCKER ARM ASSEMBLY WITH IMPROVED LATCH PIN ASSEMBLY

(71) Applicant: EATON INTELLIGENT POWER LIMITED, Dublin (IE)

(72) Inventor: Andrei Radulescu, Marshall, MI (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 18/705,272

(22) PCT Filed: Oct. 31, 2022

(86) PCT No.: PCT/EP2022/025489

§ 371 (c)(1),
(2) Date: Apr. 26, 2024

(87) PCT Pub. No.: WO2023/072432

PCT Pub. Date: May 4, 2023

(65) Prior Publication Data

US 2025/0075645 A1 Mar. 6, 2025

Related U.S. Application Data

(60) Provisional application No. 63/273,586, filed on Oct. 29, 2021.

(51) Int. Cl.

| | |
|---|---|
| ***F01L 1/46*** | (2006.01) |
| ***F01L 1/18*** | (2006.01) |
| ***F01L 13/00*** | (2006.01) |

(52) U.S. Cl.
CPC *F01L 1/46* (2013.01); *F01L 1/18* (2013.01); *F01L 13/00* (2013.01)

(58) Field of Classification Search
CPC ..... F01L 1/46; F01L 1/18; F01L 1/181; F01L 1/047; F01L 13/00; F01L 13/0005;
(Continued)

(56) References Cited

U.S. PATENT DOCUMENTS 5,549,081 A * 8/1996 Ohlendorf ..... F01L 1/267 123/90.39
2020/0408113 A1* 12/2020 Radulescu ..... F01L 1/047

FOREIGN PATENT DOCUMENTS

WO WO-2020151924 A1 * 7/2020 ..... F01L 1/181

OTHER PUBLICATIONS

International Search Report and Written Opinion for PCT/EP2022/025489, dated Feb. 22, 2023.

* cited by examiner

*Primary Examiner* — Mark A Laurenzi
*Assistant Examiner* — Kelsey L Stanek
(74) *Attorney, Agent, or Firm* — Meunier Carlin & Curfman LLC

(57) ABSTRACT

A rocker arm assembly including a cam side rocker arm portion configured to selectively rotate about a pivot location. A latch pin assembly is provided for selectively latching and deactivating rotation of the cam side rocker arm portion relative to the valve side rocker arm portion about the pivot location. The latch pin assembly includes a latch pin moveable within a cam side bore and a valve side bore. The latch pin includes an outer peripheral surface having a first portion and a second portion. The first portion has a first diameter that is less than a second diameter of the second portion. At least one of the outer peripheral surface of the latch pin or inner surfaces of the cam side bore and the valve side bore is frustoconical-shaped.

17 Claims, 10 Drawing Sheets

(58) Field of Classification Search
CPC .... F01L 13/06; F01L 2001/467; F01M 11/02; F01M 9/10
USPC ..... 123/90.39, 90.16, 90.17, 90.27, 90.44
See application file for complete search history.

ROCKER ARM ASSEMBLY WITH IMPROVED LATCH PIN ASSEMBLY

PRIORITY

This is a U.S. National Stage application of PCT international application no. PCT/EP2022/025489, filed Oct. 31, 2022, which claims the benefit of priority to U.S. provisional patent application Ser. No. 63/273,586, filed Oct. 29, 2021, the contents of each are incorporated herein by reference in their entirety.

FIELD

The subject application relates to, in general, a rocker arm assembly for use in a valve train assembly. More particularly, this application relates to a rocker arm assembly having a latch pin assembly for selectively deactivating the rocker arm assembly to allow for full lift or no lift.

BACKGROUND

Many internal combustion engines utilize rocker arms to transfer rotational motion of cams to linear motion appropriate for opening and closing engine valves. Deactivating rocker arms incorporate mechanisms that allow for selective activation (i.e. latching) and deactivation (i.e. unlatching) of the rocker arm. In some instances, returning to an activated state from a deactivated state requires precise alignment of the parts. However, this may be difficult to achieve in practice due to variations between mating parts.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY OF THE INVENTION

There is provided a rocker arm assembly including a cam side rocker arm portion configured to selectively rotate about a pivot axis. The cam side rocker arm portion includes an inner surface defining a cam side bore. A valve side rocker arm portion is configured to rotate about the pivot axis relative to the cam side rocker arm portion. The valve side rocker arm portion includes an inner surface defining a valve side bore. A latch pin assembly is provided for selectively latching and unlatching the cam side rocker arm portion relative to the valve side rocker arm portion. The latch pin assembly includes a latch pin moveable within the cam side bore and the valve side bore. The latch pin includes an outer surface. At least one of the outer surface of the latch pin, the inner surface of the cam side bore, and the inner surface of the valve side bore is frustoconical-shaped.

In the rocker arm assembly, a step is provided between a first portion and a second portion of the latch pin.

In the rocker arm assembly, a ramp is provided between a first portion and a second portion of the latch pin.

In the rocker arm assembly, at least one of the outer surface of the latch pin, the inner surface of the cam side bore, and the inner surface of the valve side bore is tapered at an angle between about 0.4 degrees and about 3.0 degrees with respect to a longitudinal axis of the latch pin, the cam side bore or the valve side bore, respectively.

In the rocker arm assembly, the angle is about 0.8 degrees.

In the rocker arm assembly, the cam side rocker arm portion further includes a cam end configured to receive a lift profile from a cam lobe. a lost motion spring spans between the cam side rocker arm portion and the valve side rocker arm portion for biasing rotation about the pivot axis.

In the rocker arm assembly, the latch pin has a first portion and a second portion and the first portion has a first diameter that is less than a second diameter of the second portion.

In the rocker arm assembly, when the latch pin is tilted within the cam side bore and the valve side bore a surface contact is provided where a first portion of the latch pin engages the valve side bore and a second surface contact is provided where a second portion of the latch pin engages the valve side bore.

There is further provided, a rocker arm assembly including a cam side rocker arm portion configured to selectively rotate about a pivot axis. The cam side rocker arm portion includes a cam side bore. A valve side rocker arm portion is configured to rotate about the pivot axis relative to the cam side rocker arm portion. The valve side rocker arm portion includes a valve side bore. A latch pin assembly is provided for selectively latching and unlatching the cam side rocker arm portion relative to the valve side rocker arm portion about the pivot axis. The latch pin assembly includes a latch pin moveable within the cam side bore and the valve side bore. The latch pin includes a first portion and a second portion. Both the first portion and the second portion are frustoconical-shaped.

In the rocker arm assembly, both the first portion and the second portion are tapered at an angle between about 0.4 degrees and about 3.0 degrees with respect to a longitudinal axis of the latch pin.

In the rocker arm assembly, the angle is about 0.8 degrees.

In the rocker arm assembly, an inner surface of the cam side bore is cylindrical-shaped.

In the rocker arm assembly, an inner surface of the valve side bore is cylindrical-shaped.

In the rocker arm assembly, when the latch pin is tilted within the cam side bore and the valve side bore a surface contact is provided where the first portion of the latch pin engages the valve side bore and the second surface contact is provided where a second portion of the latch pin engages the valve side bore.

There is furthermore provided, a rocker arm assembly including a cam side rocker arm portion configured to selectively rotate about a pivot axis. The cam side rocker arm portion includes a cam end configured to receive a lift profile from a cam lobe. The cam side rocker arm portion includes a cam side bore. A valve side rocker arm portion is coupled to the cam side rocker arm portion and is configured to rotate about the pivot axis relative to the cam side rocker arm portion. The valve side rocker arm portion includes a valve side bore. A latch pin assembly is provided for selectively latching and unlatching the cam side rocker arm portion relative to the valve side rocker arm portion about the pivot axis. The latch pin assembly includes a latch pin moveable within the cam side bore and the valve side bore. The latch pin includes a main portion and a reduce portion. Inner surfaces of the cam side bore and the valve side bore are frustoconical-shaped.

In the rocker arm assembly, the inner surfaces of the cam side bore and the valve side bore are tapered at an angle between about 0.4 degrees and about 3.0 degrees.

In the rocker arm assembly, the angle is about 0.8 degrees.

In the rocker arm assembly, the main portion of the latch pin is frustoconical-shaped.

In the rocker arm assembly, the reduced portion of the latch pin is frustoconical-shaped.

In the rocker arm assembly, the main portion of the latch pin is cylindrical-shaped.

In the rocker arm assembly, the reduces portion of the latch pin is cylindrical-shaped.

In the rocker arm assembly, both the main portion and the reduced portion are frustoconical-shaped and tapered in the same direction.

In the rocker arm assembly, a diameter of the main portion is greater than a diameter of the reduced portion.

In the rocker arm assembly, a diameter of the reduced portion is less than a diameter of the cam side bore.

In the rocker arm assembly, the latch pin assembly further includes a piston disposed in the valve side bore.

In the rocker arm assembly, there is provided a biasing member against a plug in the cam side bore. The latch pin is configured to telescope in and out of the cam side bore and the plug is set in the cam side bore to a depth to control a distance that the latch pin telescopes.

In the rocker arm assembly, when the latch pin is tilted within the cam side bore and the valve side bore a surface contact is provided where the reduced portion engages the valve side bore and a second surface contact is provided where the main portion engages the valve side bore.

In the rocker arm assembly, inner surfaces of the cam side bore and the valve side bore are tapered in opposite directions.

DETAILED DESCRIPTION

The following presents a description of the disclosure; however, aspects may be embodied in many different forms and should not be construed as limited to the embodiments set forth herein. Furthermore, the following examples may be provided alone or in combination with one or any combination of the examples discussed herein. Directional references such as "left" and "right" are for ease of reference to the figures.

A detailed description of a rocker arm assembly 10 is provided in U.S. application Ser. No. 17/018,008, filed Sep. 11, 2020, the contents of which are incorporated herein by reference. A brief description of the rocker arm assembly 10 is provided below.

Figure 1A:
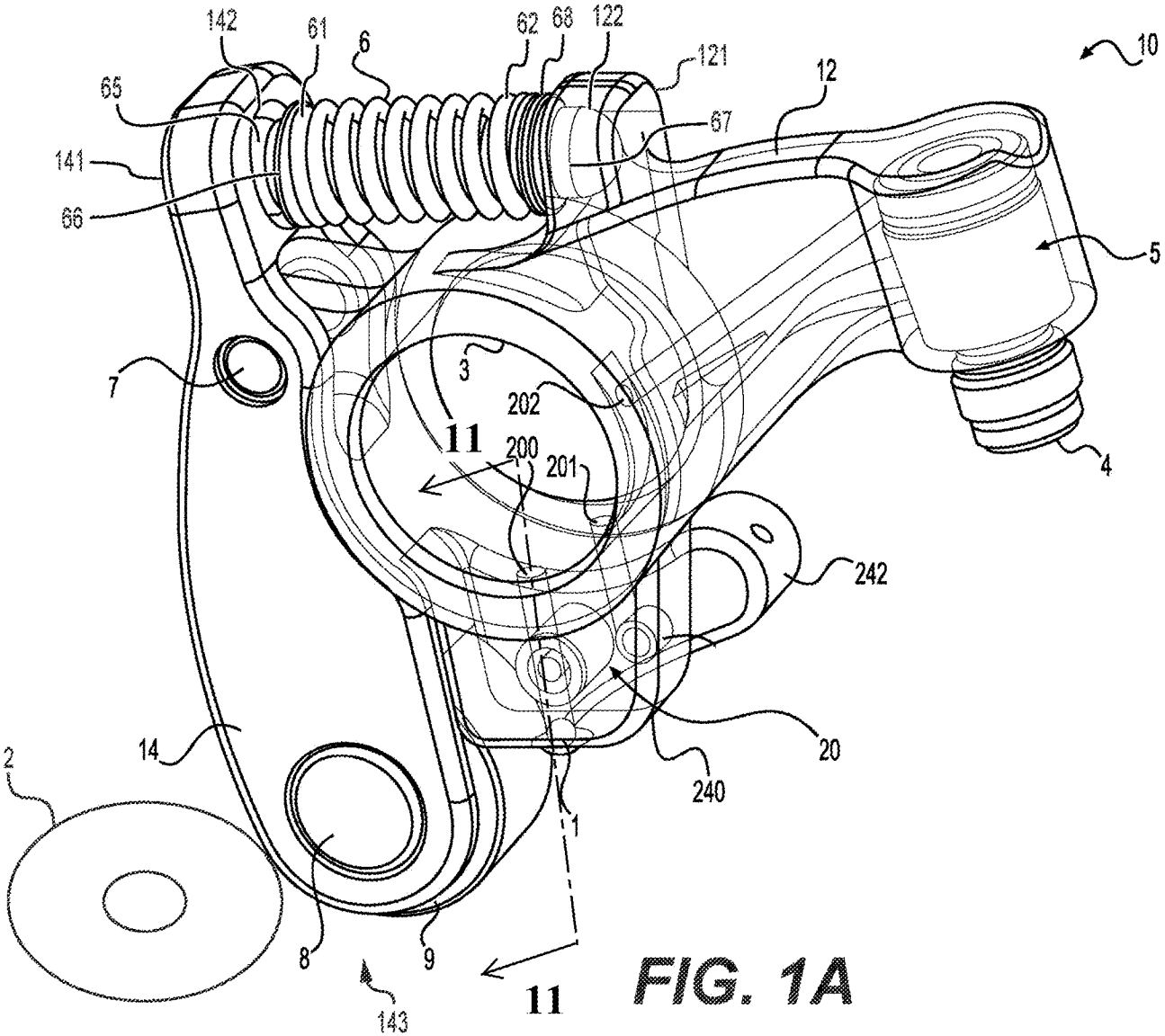
FIG. 1A is a perspective view of a rocker arm assembly having a first pivot location.

With reference to FIG. 1A, the rocker arm assembly 10 is shown to include a valve side rocker arm portion 12 and a cam side rocker arm portion 14. A latch pin assembly 20 moves between various positions to achieve different operating conditions. The latch pin assembly 20 operates as a mechanical latch pin for deactivating the rocker arm assembly 10. In this regard, the rocker arm assembly 10 is capable of full lift or no lift.

The rocker arm assembly 10 is shown as a type III, center pivot rocker arm. It comprises a roller bearing 9 on a bearing axis 8 for interfacing with a cam rail (not shown). A cam lobe 2 on the cam rail can impart a valve lift profile to the rocker arm assembly 10 by transferring actuation forces to the roller bearing 9 or alternative tappet at the cam end 143 of the cam side rocker arm portion 14. A tappet interface can substitute for the roller bearing 9 and bearing axis 8. The roller bearing 9 or tappet of the cam end 143 can be below the pivot location, among other locations.

The pivot location can be at a pivot axle 7 joining bores in the cam side rocker arm portion 14 and valve side rocker arm potion 12. Or, the pivot location can be formed by a body portion 17 (FIG. 1B) of the cam side rocker arm portion 14. Body portion 17 can be configured to partially or completely encircle a rocker shaft (not shown) adjacent rocker shaft bore 3 of valve side rocker arm portion 12.

Figure 1B:
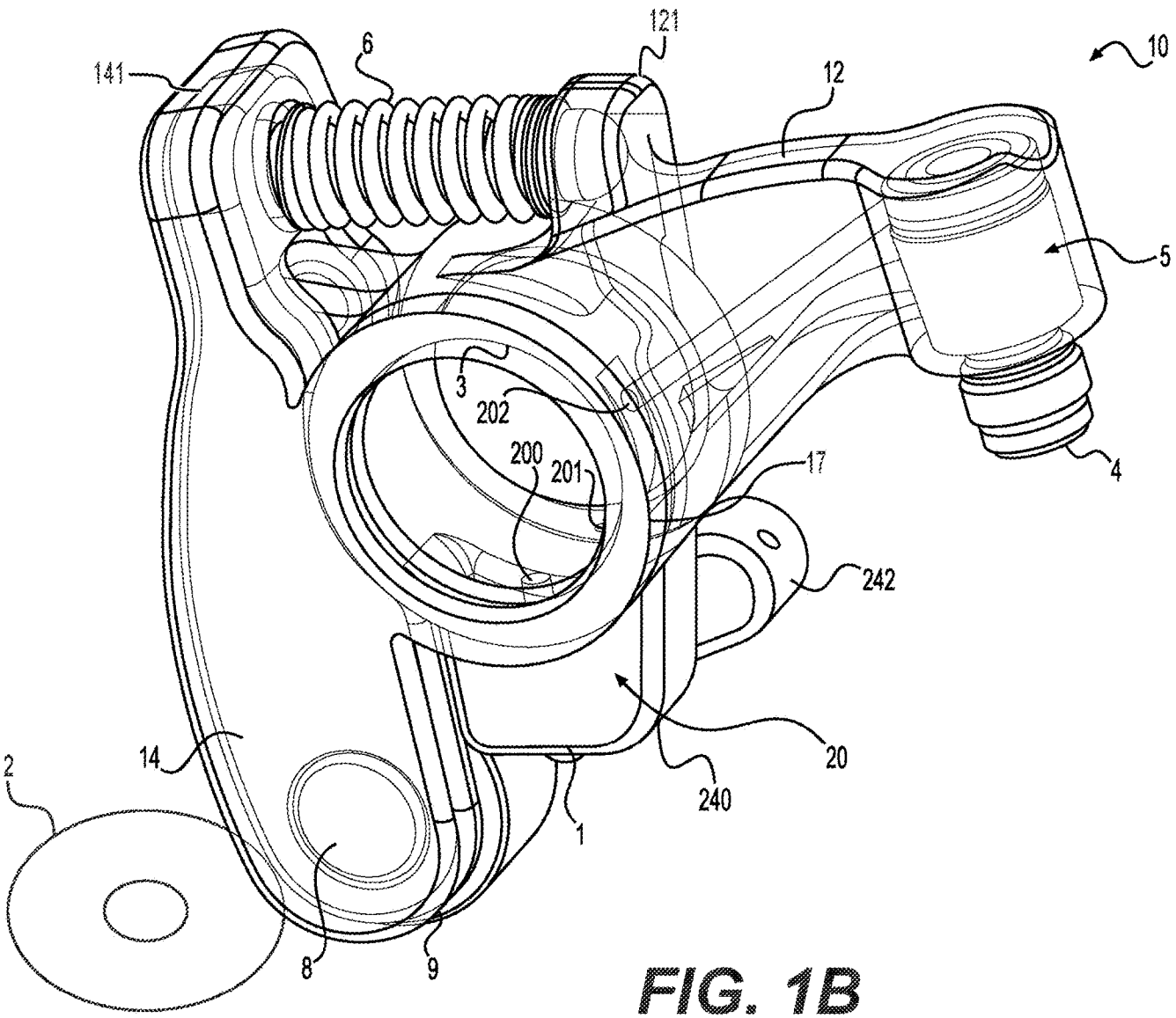
FIG. 1B is a perspective view of a rocker arm assembly having a second pivot location.

With reference to FIG. 1A, the cam side rocker arm portion 14 and the valve side rocker arm portion 12 can pivot with respect to one another, rotating around the pivot axle 7. Or, the pivot location for the cam side rocker arm portion 14 and the valve side rocker arm portion 12 can be shared about the rocker shaft bore 3, as by extending the material of the body portion 17 of the cam side rocker arm portion 14 around the rocker shaft bore and eliminating the pivot axle 7 as shown in FIG. 1B. Then, rotation is around the rocker shaft for both portions of the rocker arm assembly 10.

A spring 6 can be biased between the cam side rocker arm portion 14 and the valve side rocker arm portion 12. The spring can enable lost motion valve lift profiles, including zero lift profiles, when the latch pin assembly 20 is configured for lost motion. And, the spring 6 can bias the cam side rocker arm portion 14 and valve side rocker arm portion 12 for lift/no lift profiles. Other specialty lift profiles are also contemplated. A first end 61 of spring 6 can seat on a lip 66 of a first positioning pin 65. A second end 62 of spring 6 can seat on a second lip 68 of a second positioning pin 65. Cam side rocker arm portion 14 can comprise a knurl 141 with a first socket 142 to form a ball-and-socket arrangement with the first positioning pin 65. Valve side rocker arm portion 12 can comprise a second knurl 121 with a second socket 122 to form a ball-and-socket arrangement with the second positioning pin 67. Second knurl 121 can protrude away from the pivot location as by extending away from the portion of valve side rocker arm portion 12 that is around pivot axle 7. First and second positioning pins 65, 67 can comprise a rounded surface to interface with the first and second sockets 142, 122. Another construction for spring end retention is a flat interface preferably at the valve side arm. The spring 6 end is located in a flat pocket of the valve side arm. A sliding, rocking, twisting, or other motion can occur in the first and second sockets 142, 122 as the spring 6 flexes during rocker arm assembly 10 use. The spring 6 can have a spring force to push the valve side rocker arm portion 12 away from the cam side rocker arm portion 14. But when the latch pin assembly 20 is unlatched, the knurl 141 can press the spring 6 and collapse it towards the knurl 121. The spring force of spring 6 can be less than the force necessary to move the valve end 4 while of sufficient strength so that the roller 9 or tappet follows the cam 2.

In lieu of the first or second positioning pin 65, 67, the spring 6 can be formed so that the first and second ends 61, 62 can flex and move in the first and second sockets 142, 122 in a ball-and-socket arrangement. The first and second ends 61, 62 can be turned in a tapering shape, for example. In lieu of the first and second positioning pin 65, 67, the first and second sockets 142, 122 can comprise a stationary stake, pin, stepped surface, or other spring guide. Or, the first and second positioning pin 65, 67 can comprise a stake, pin, stepped surface or other spring guide in addition to or alternative to lips 66, 68. The spring guide can allow the spring 6 to flex yet restrict the spring 6 so that it does not stray off the rocker arm assembly 10. Spring guide can comprise a raised portion that forms the spring seat. This raised portion can interface with an inner diameter of the spring 6 to ensure that the spring 6 does not lose contact with the first and second sockets 142, 122 or first and second positioning pins 65, 67.

The valve side rocker arm portion 12 can comprise a variety of additional aspects such as a lash adjuster, deactivating capsule, engine brake capsule, among others as by an insert 5. An engine valve stem can connect directly or indirectly at an elephant foot (e-foot), spigot, cleat, or other guide at the valve end 4, and valve bridges and other valve connections can be used.

Figure 2:
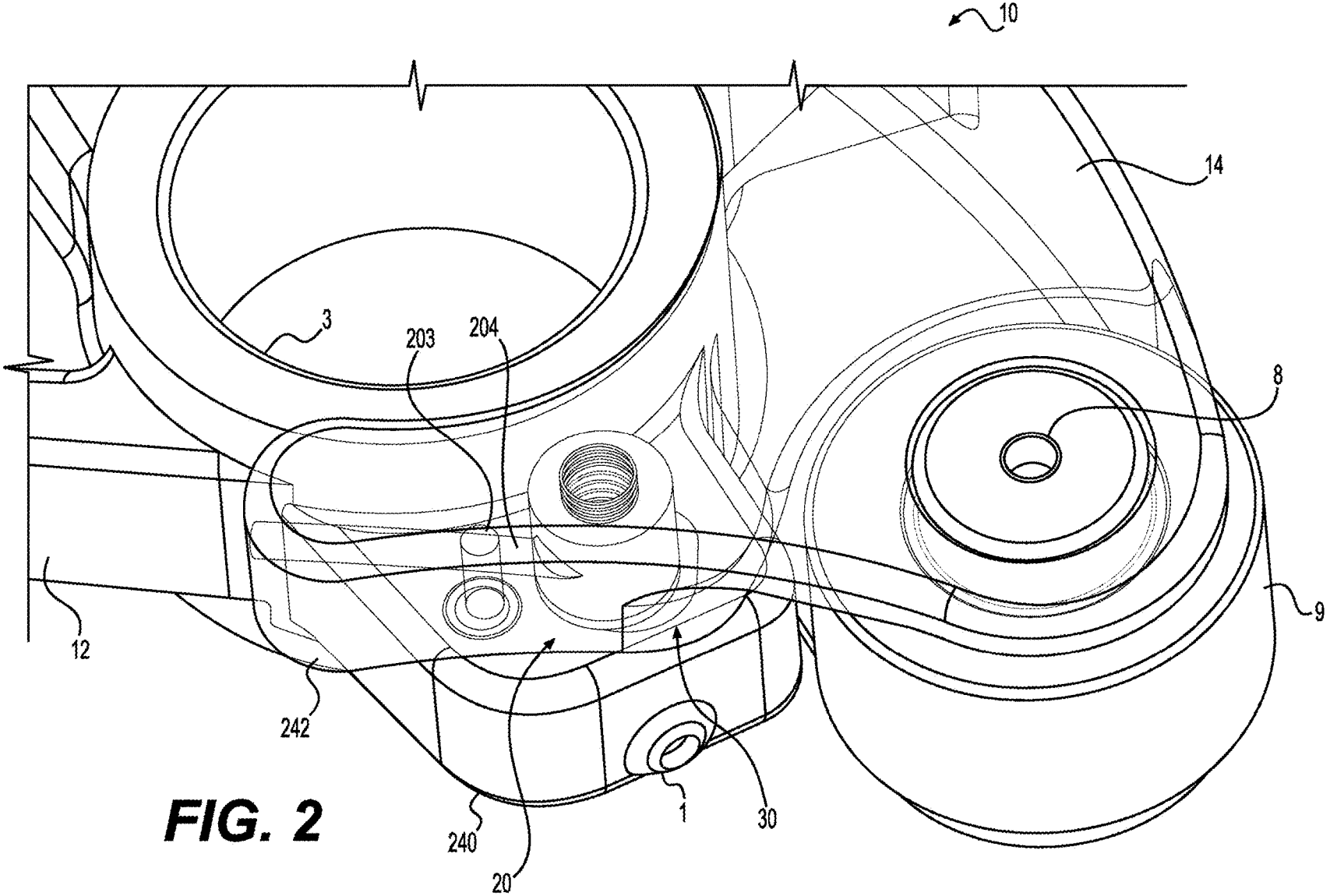
FIG. 2 is an enlarged perspective view of a latch pin assembly of the rocker arm assembly of FIG. 1A.

The rocker shaft bore 3 can couple to a rocker shaft and the rocker shaft can be configured to supply pressurized control fluid to the rocker arm assembly 10. Then, internal oil channels 200-204 can supply control fluid. For example, oil channel 202 can supply control fluid to enable hydraulic lash adjustment in the insert 5, or to enable engine braking or cylinder deactivation functionality, as per the insert 5. Oil channel 200 in valve side latch body 240 of valve side rocker arm portion 12 can supply control fluid to the latch pin assembly 20. Oil channel 201 in cam side latch body 242 can supply a separate control fluid. Oil channels 200-202 connect to receive fluid from the rocker shaft bore 3, and oil channels 203, 204 (FIG. 2) can be formed for additional functionality. The oil channels 200-204 can be drilled or cast or otherwise formed into the rocker arm assembly 10, and in some alternatives plug 1 can be used to fluidly seal an end of the oil channel, as shown for oil channel 200 in FIG. 1A. Or, a controlled leak path or relief path (not shown) can be formed through the plug, as in FIG. 2. Control of the pressurized fluid in the oil channels 200-204 permit control of the rocker arm assembly 10 functionality, in particular, control of the latch pin assembly.

Figure 3:
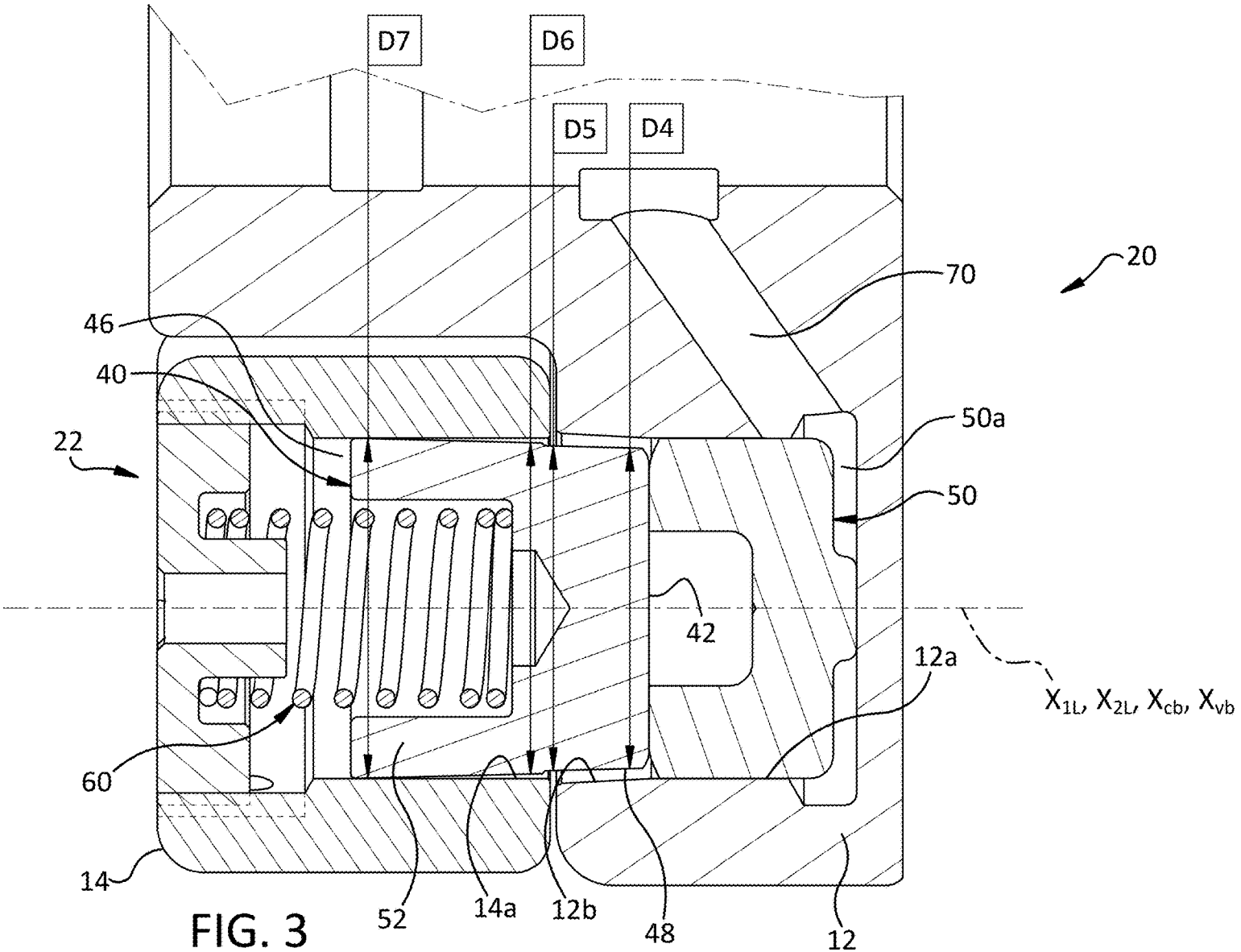
FIG. 3 is a sectional view of one embodiment of a latch pin assembly, taken along line 11-11 of FIG. 1A.

Referring to FIG. 3, the latch pin assembly 20 moves between various positions to achieve different operating conditions. The latch pin assembly 20 operates as a mechanical latch pin for selectively activating (i.e., latching) and deactivating (i.e., unlatching) the rocker arm assembly 10. In this regard, the rocker arm assembly 10 is capable of full lift or no lift.

The latch pin assembly 20 includes a latch pin 40 and a piston 50. The latch pin 40 is configured to slide within a cam side bore 14*a* of the cam side rocker arm portion 14 and partially within a valve side bore 12*a* of the valve side rocker arm portion 12*a*. The piston 50 is configured to slide within the bore 12*a* of the valve side rocker arm portion 12. In FIG. 3, the latch pin assembly 20 is shown in an unloaded state wherein the longitudinal axis Xvb of the bore 12*a*, a longitudinal axis $X_{2L}$ of the piston 50, a longitudinal axis $X_{cb}$ of the bore 14*b* and a longitudinal axis $X_{1L}$ of the latch pin 40 are all axially aligned.

A biasing member 60 is compressed between a plug 22 and the latch pin 40 for biasing the latch pin 40 toward the piston 50. When in the latched position, the latch pin 40 extends into the bore 12*a* formed in the valve side rocker arm portion 12. At this point, the latch pin assembly 20 is in a latched position. In this position, the cam side rocker arm portion 14 is locked to the valve side rocker arm portion 12, so that lift forces from the cam 2 are transferred to the valve end 4 of the rocker arm assembly 10, i.e., full lift.

The plug 22 is threaded into the bore 14*a* of the cam side rocker arm portion 14 at a depth to control the distance that the latch pin 40 telescopes within the bore 14*a*. For example, increasing the distance that the plug 22 is threaded into the bore 14*a*, reduces the distance that the latch pin 40 may move within the bore 14*a*. The movement of the latch pin 40 within the bore 14*a* can be increased by reducing the distance that the plug 22 is threaded into the bore 14*a*.

When pressurized fluid is supplied to the valve side bore 12*a* via port 70 (e.g., via connection with oil channel 200), the biasing member 60 is compressed. The pressurized fluid engages a face 50*a* of the piston 50 thereby causing the piston 50 to engage a mating face 42 of the latch pin 40. This pressure then causes the latch pin 40 to move toward the plug 22. When the force applied by the pressurized fluid has exceeded the force of the biasing member 60, the biasing member 60 is compressed and the latch pin 40 moves toward the plug 22. The latch pin 40 moves until a first end 46 abuts the plug 22. At this point, the latch pin assembly 20 is in an unlatched position. In the unlatched position, lift forces from the cam 2 are lost because the cam side rocker arm portion 14 can move without transferring forces to the valve side rocker arm portion 12, i.e., no lift.

Figure 4:
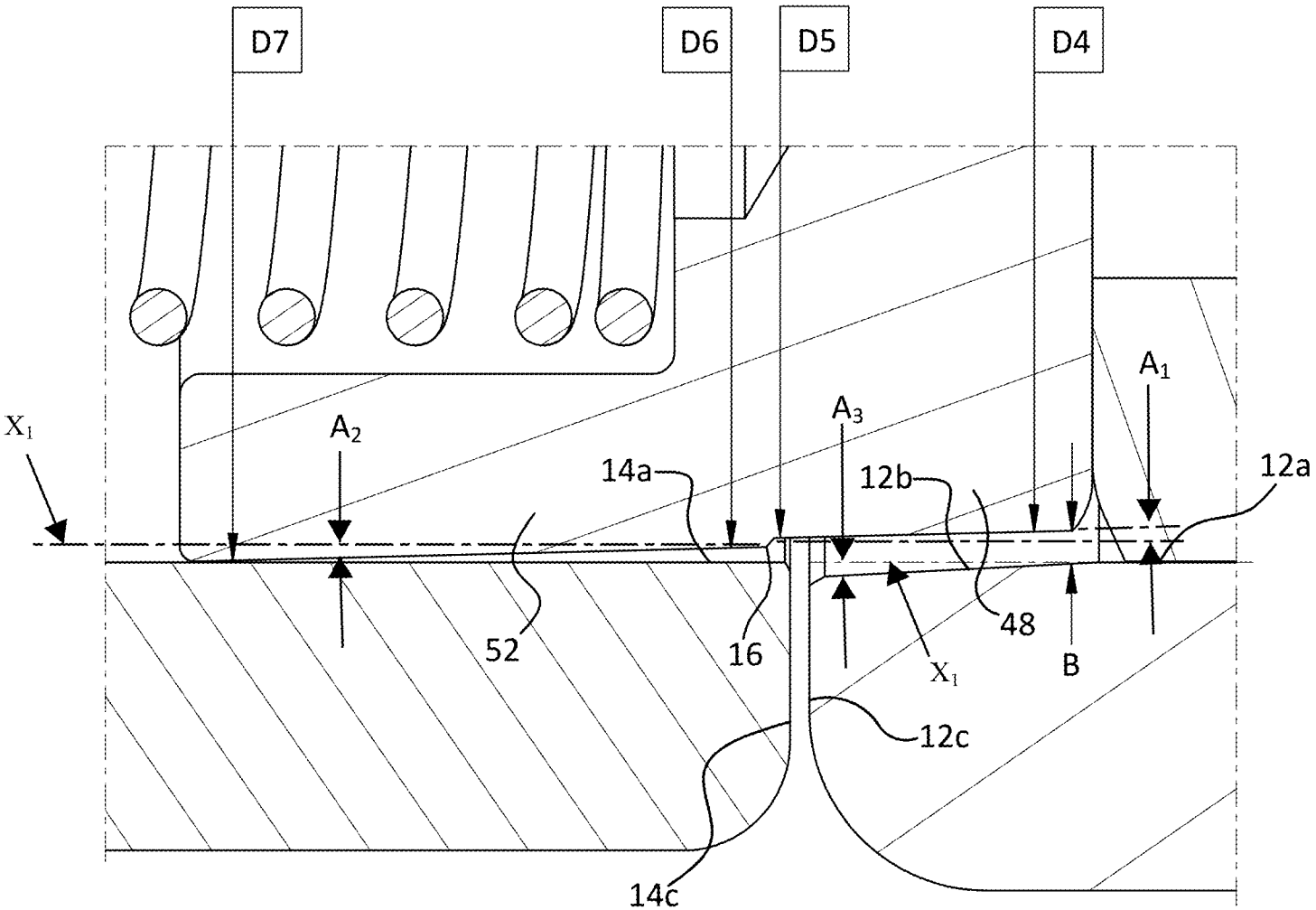
FIG. 4 is an enlarged sectional view of the latch pin assembly of FIG. 3.

The latch pin 40 includes a first or reduced portion 48 and a second or main portion 52. The first portion 48 is frustoconical-shaped and increases from a first end diameter D4, at one end, to a first intermediate diameter D5 at an intermediate location along the longitudinal axis of the latch pin 40. The first end diameter D4 is less than the first intermediate diameter D5. The first portion 48 is tapered at an angle $A_1$ measured relative to a tangent line $X_1$ that is parallel to a longitudinal axis $X_{1L}$ (FIG. 3) of the latch pin 40. The second portion 152 is frustoconical-shaped and increases from a second intermediate diameter D6 at the intermediate location to a second end diameter D7, at a second opposite end of the latch pin 40. The second intermediate diameter D6 is less than the second diameter D7. The second portion 52 is tapered at an angle $A_2$ measured relative to a tangent line $X_1$ that is parallel to a longitudinal axis $X_{1L}$ (FIG. 3) of the latch pin 40. It is contemplated that the angle $A_1$ may be equal to the angle $A_2$. The second intermediate diameter D6 is also greater than the first intermediate diameter D5 such that a step is formed between the first portion 48 and the second portion 52. It is contemplated that the transition 16 (FIG. 4) between the first portion 48 and the second portion 52 may have any of a number of shapes, for example, but not limited to, a sharp step, a steep ramp or a radius or combinations thereof. In the embodiment illustrated in FIGS. 3-5, bore 14*a* of the cam side rocker arm portion 14 is cylindrical-shaped with a constant diameter. Referring to FIG. 4, an end portion 12*b* of the bore 12*a* of the valve side rocker arm portion 12 is tapered by an angle $A_3$ measured relative to a tangent line $X_1$ that is parallel to a longitudinal axis $X_{vb}$ (FIG. 3) of the bore 12*a*.

Figure 5:
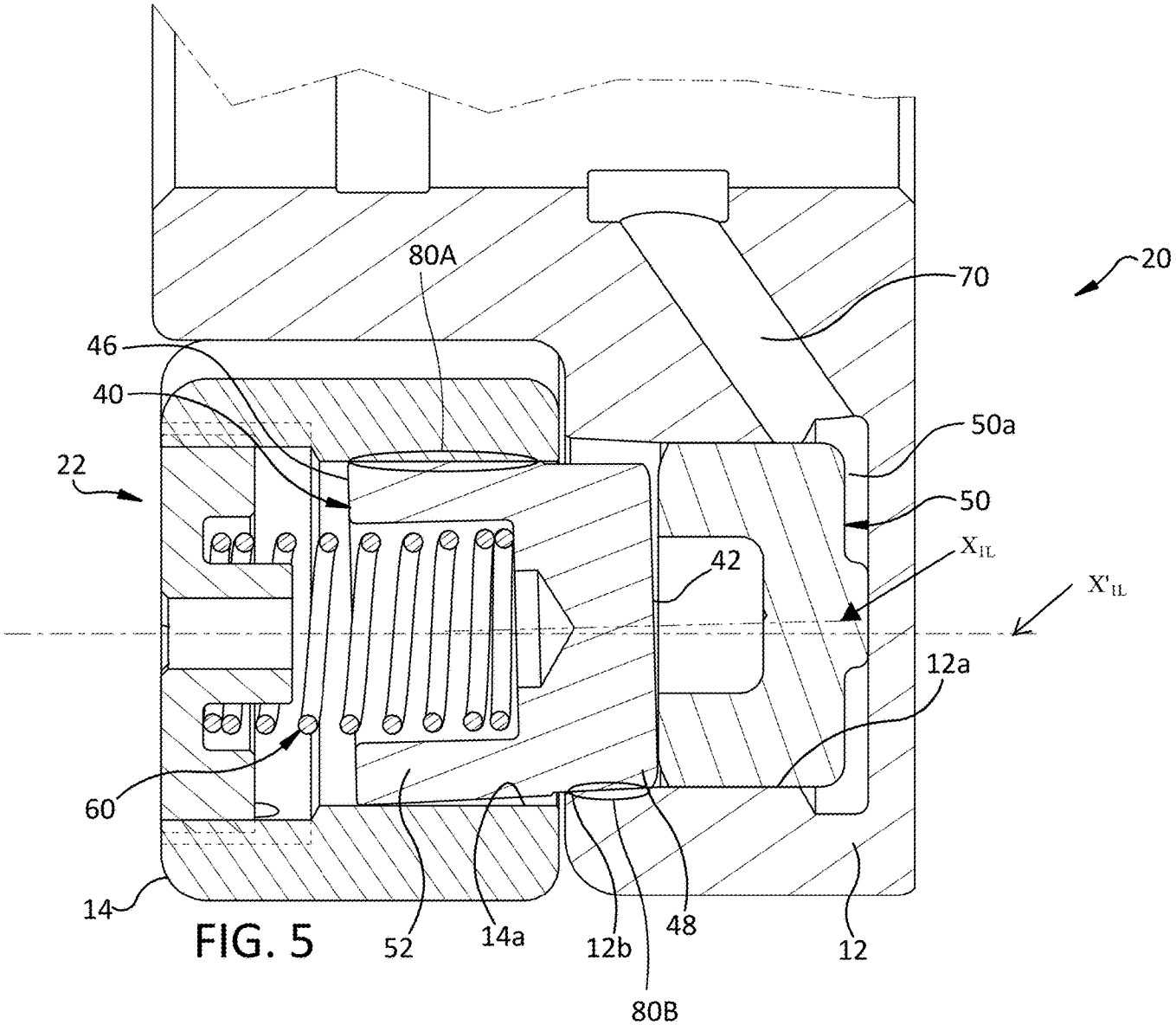
FIG. 5 is a sectional view of the latch pin assembly of FIG. 3, showing a latch pin tilted.

Referring to FIG. 5, when the cam side rocker arm portion 14 and the valve side rocker arm portion 12 move relative to each other to a loaded condition (e.g., when displacement is imparted to the cam side rocker arm portion 14 via the cam shaft), the latch pin 40 is tilted within the bore 14*a* relative to its initial position $X'_{1L}$. In this tilted position, a segment of the outer surface of the second portion 52 engages a segment of the inner surface of bore 14*a* at a location 80A (FIG. 5) and, on an opposite side of the latch pin 40, a segment of the outer surface of the first portion 48 engages a segment of an inner surface of the end portion 12*b* of the bore 12*a* at a location 80B. As illustrated in FIG. 5, the engagement between the surfaces of the latch pin 40 and the bores 12*a*, 14*a* is a segment to segment contact and is an increase in contact area as compared to latch pin assemblies known heretofore. This increased contact area reduces the stress experienced by the latch pin 40 and the bores 12*a*, 14*a*.

Figure 6:
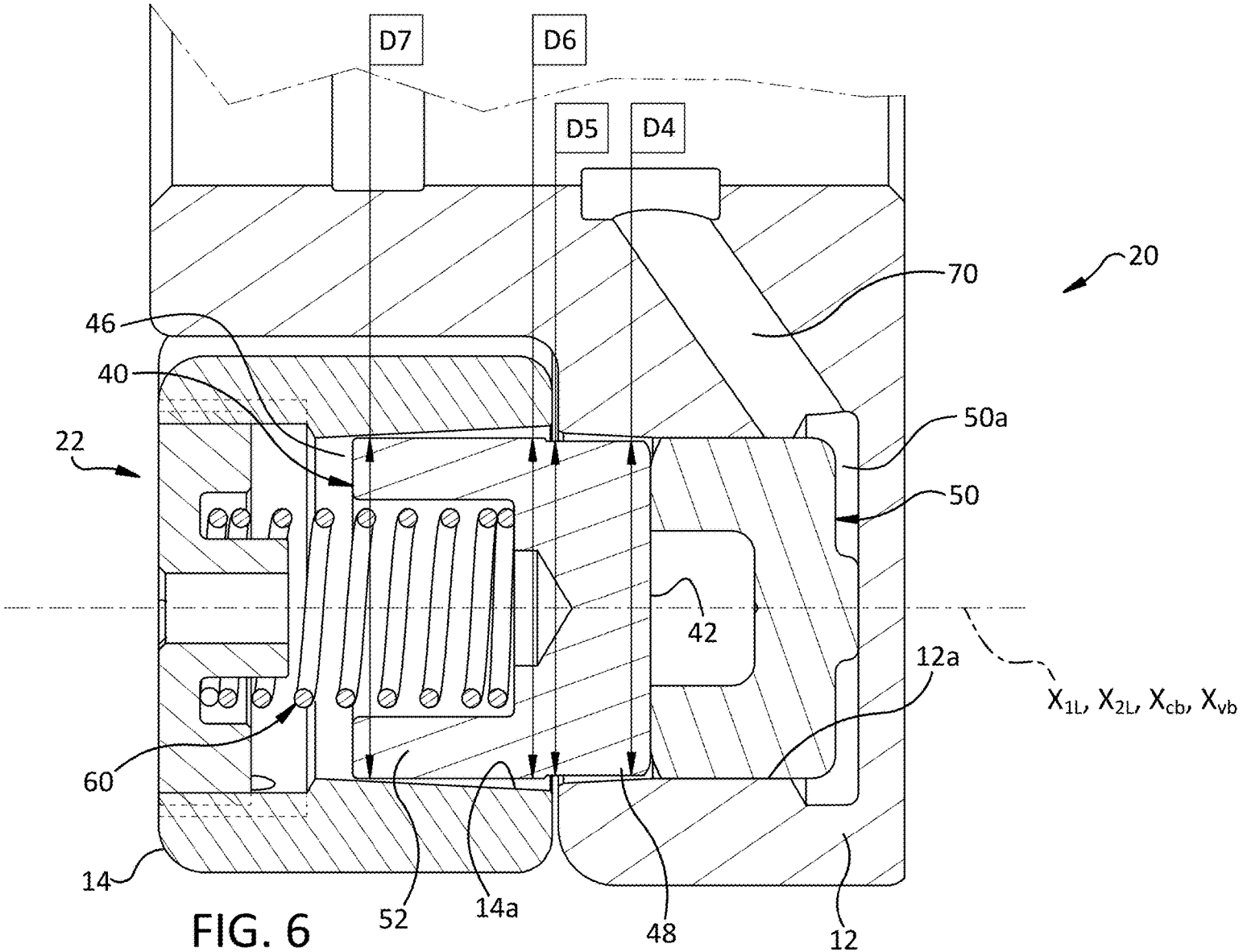
FIG. 6 is a sectional view of another embodiment of a latch pin assembly, taken along line 11 of FIG. 1A.
Figure 7:
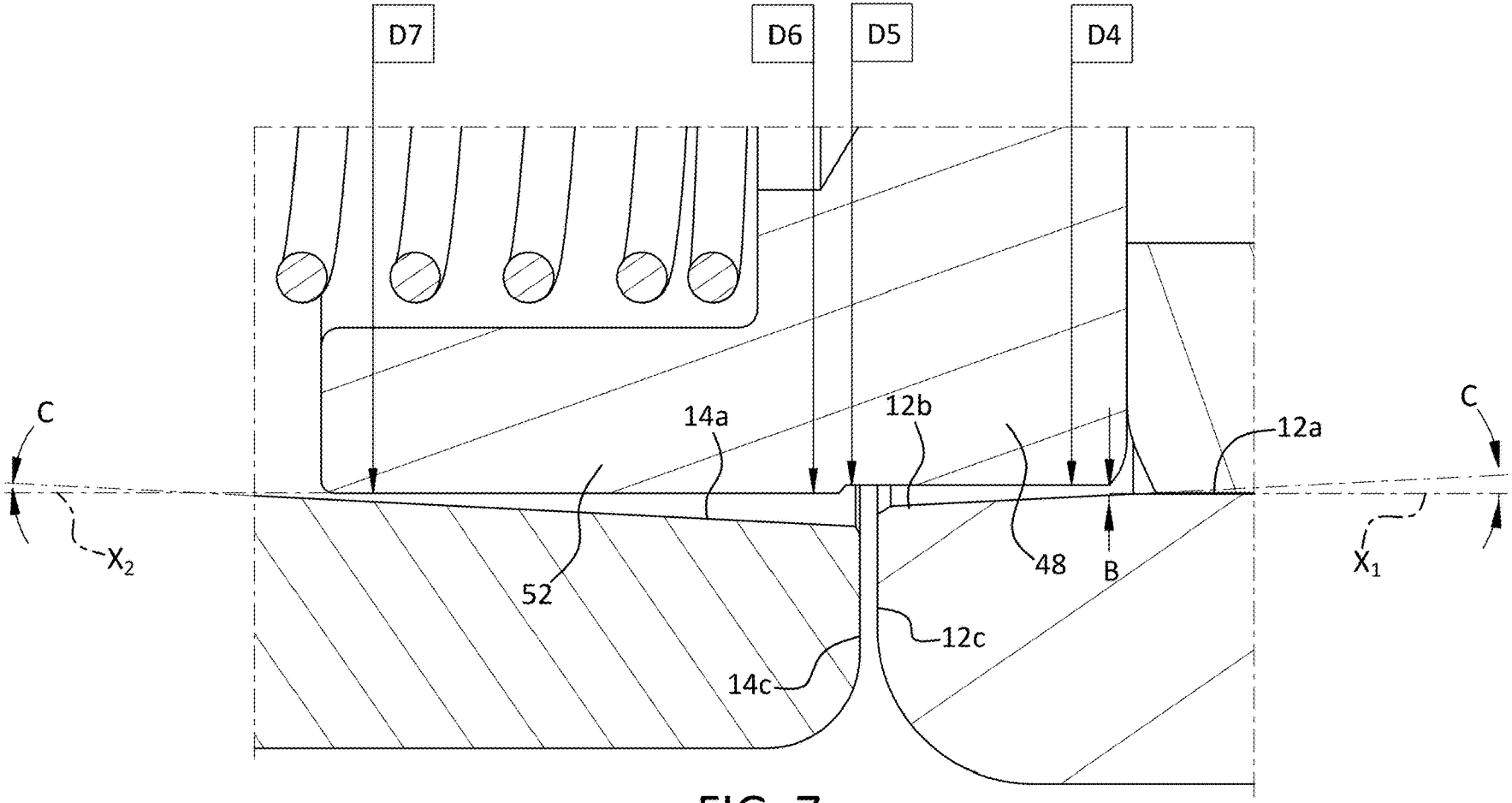
FIG. 7 is an enlarged sectional view of the latch pin assembly of FIG. 6.
Figure 8:
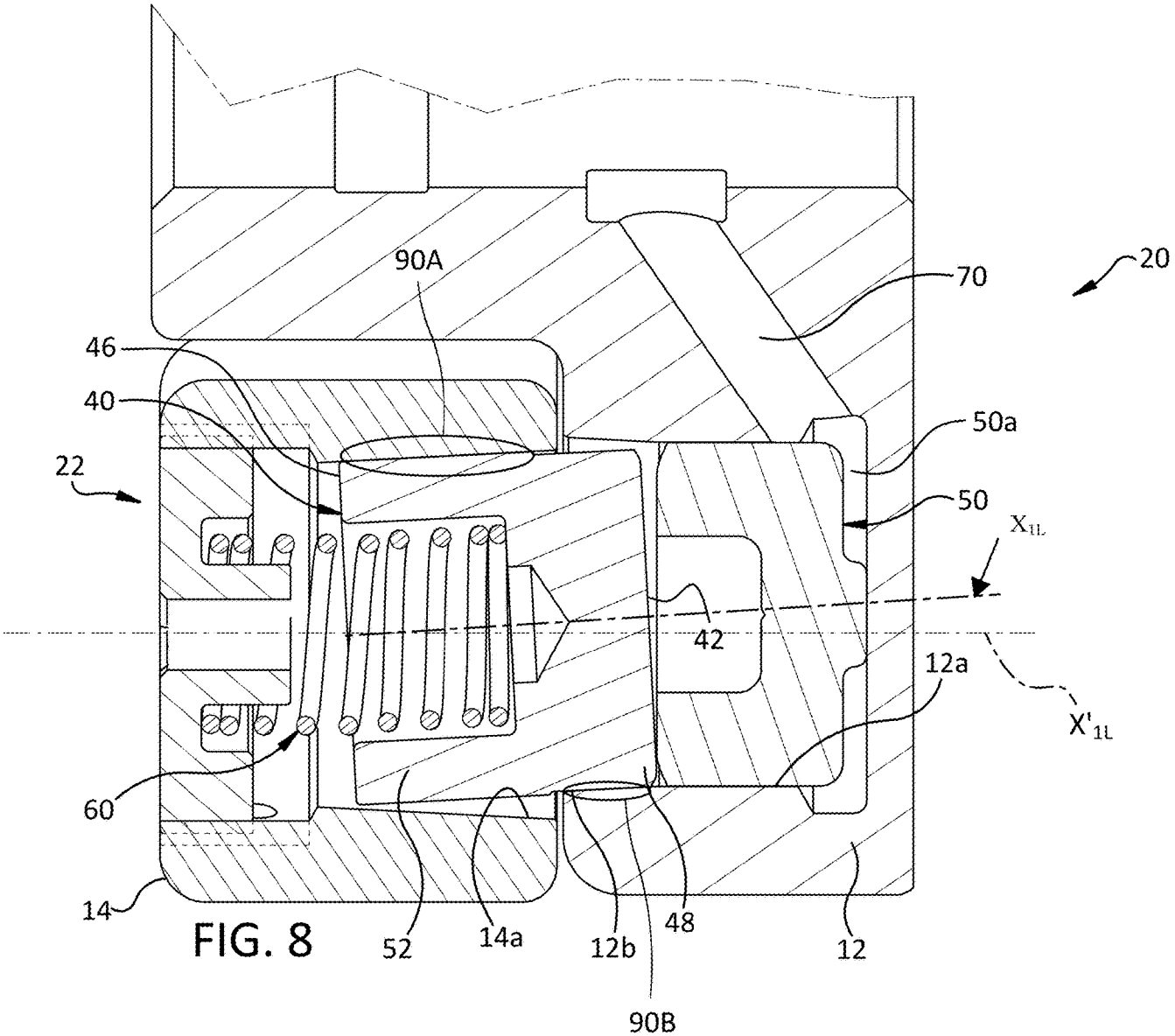
FIG. 8 is a sectional view of the latch pin assembly of FIG. 6, showing a latch pin tilted.

In another embodiment, illustrated in FIGS. 6-8, the first and second portions 48, 52 of the latch pin 40 have constant diameters, e.g., the first end diameter D4 equals the first intermediate diameter D5 and the second intermediate diameter D6 equals the second end diameter D7, but the bores 12*a*, 14*a* are frustoconical-shaped. Referring to FIG. 7, in particular, the end portion 12*b* of the bore 12*a* is tapered and the entire bore 14*a* is tapered. It is contemplated that, similar to bore 12*a*, an end portion of the bore 14*a* may be tapered. The end portion 12*b* is tapered at an angle C as measured relative to the tangent axis $X_1$ that is parallel to the longitudinal axis $X_{vb}$ of the bore 12*a* and the bore 14*a* is tapered in the opposite direction at an angle C as measured relative to a tangent axis $X_2$ that is parallel to the longitudinal axis $X_{cb}$ of the bore 14*a*.

Referring to FIG. 8, in this embodiment, when the cam side rocker arm portion 14 and the valve side rocker arm portion 12 move relative to each other to a loaded condition (e.g., when displacement is imparted to the cam side rocker arm portion 14 via the cam shaft), the latch pin 40 is tilted within the bore 14*a* relative to its initial position $X'_{1L}$. In this tilted position, a segment of the outer surface of the second portion 52 engages a segment of the inner surface of bore 14*a* at location 90A and, on an opposite side of the latch pin 40, a segment of the outer surface of the first portion 48 engages a segment of an inner surface of the end portion 12*b* of the bore 12*a* at a location 90B. As illustrated in FIG. 8, as in the previous embodiment, the engagement between the surfaces of the latch pin 40 and the bores 12*a*, 14*a* is a segment to segment contact and is an increase in contact area as compared to latch pin assemblies known heretofore. This increased contact area reduces the stress experienced by the latch pin 40 and the bores 12*a*, 14*a*.

As described above, the first and second portions 48, 52 of the latch pin 40 and/or the bores 12*a*, 14*a* are frustoconical-shaped. By way of example, it is contemplated that the taper angles $A_1$, $A_2$, $A_3$ and C (FIGS. 4 and 7) may be between about 0.4 degrees and about 3.0 degrees, preferably about 0.8 degrees.

In the embodiments described above, the first portion 48 and the second portion 52 of the latch pin 40 are either both cylindrical-shaped or frustoconical-shaped. It is contemplated that the first portion 48 may be cylindrical-shaped and the second portion 52 frustoconical-shaped, or vice versa. In these alternative embodiments (not shown), the corresponding surfaces of the bores 12*a*, 14*a* may be contoured, i.e., tapered or cylindrical-shape to achieve segment to segment contact when the latch pin 40 is tilted.

In the first embodiment described above, the first portion 48 is described as being frustoconical-shaped and the bore 14*a* is cylindrical-shaped. In the second embodiment, the first portion 48 is cylindrical-shaped and the bore 14*a* is frustoconical-shaped. It is contemplated that both the first portion 48 and the bore 14*a* may be frustoconical-shaped so long as segment to segment contact is achieved when the latch pin 40 is tilted.

It is also contemplated that the gap B (FIGS. 4 and 7) between one of the bores 12*a*, 14*a* and the outer diameter of the latch pin 40 can be used to set the lash of the rocker arm assembly 10. The latch pin 40 may thereby serve as a lash setting pin for setting the lash of the rocker arm assembly 10.

Figure 9:
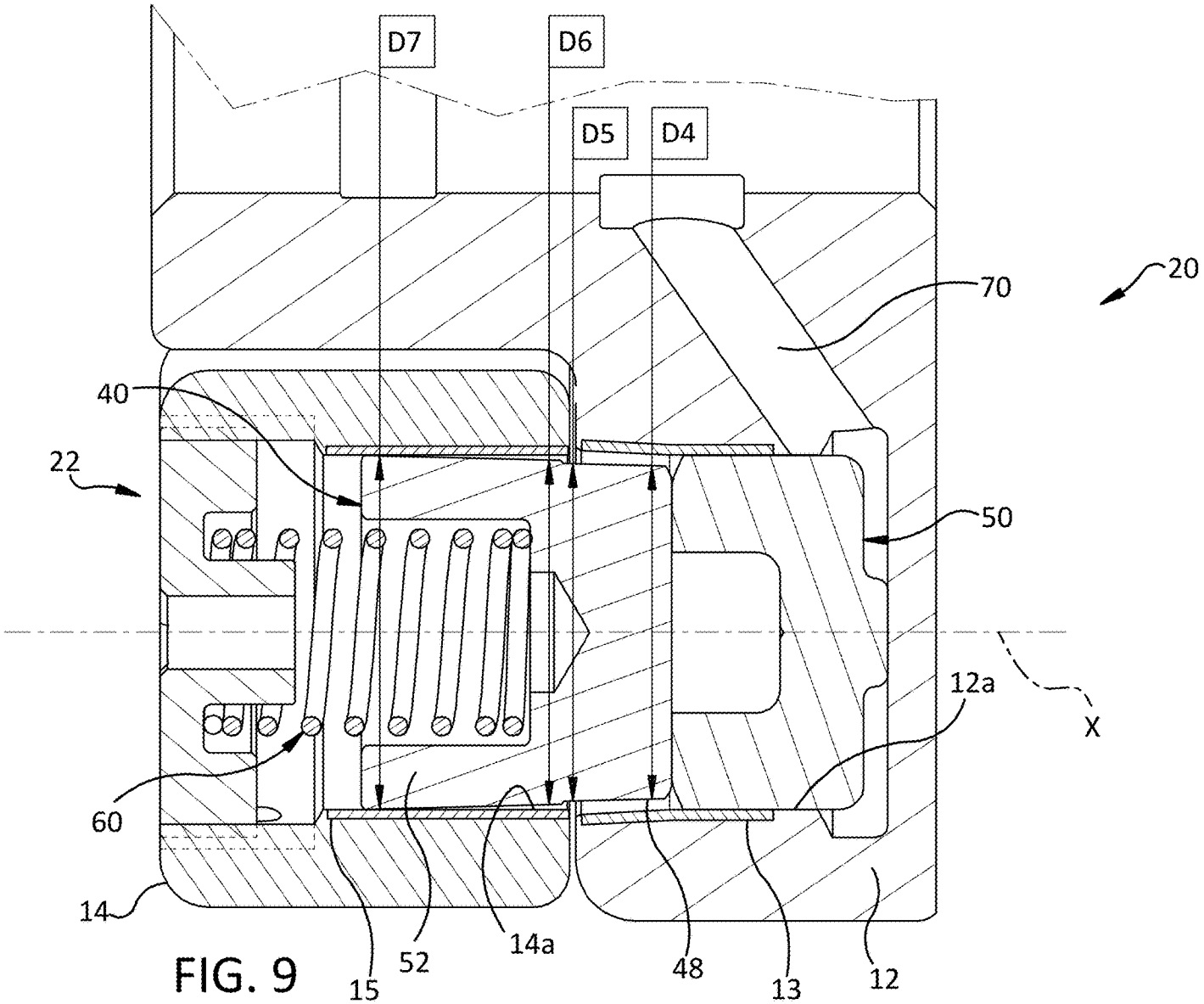
FIG. 9 is a sectional view of another embodiment of a latch pin assembly.

Referring to FIG. 9, according to yet another embodiment, liners 13, 15 may be positioned in the bores 12*a*, 14*a*, respectively. The liners 13, 15 may be made of a material that has a higher yield strength as compared to the arm portions 12, 14. When the latch pin 40 is tilted in the bores 12*a*, 14*a*, the latch pin 40 will engage the liners 13, 15 as opposed to the material of the inner surfaces of the arm portions 12, 14 that define the bores 12*a*, 14*a*. The liners 13, 15 may be selected of a material to withstand more force than the arm portions 12, 14 so the latch pin 40 may be used in higher stress applications as compared to assemblies that do not utilize liners.

It will be apparent to those skilled in the art that various modifications and variations can be made without departing from the spirit and scope of the claimed invention.

What I claim is:

1. A rocker arm assembly comprising:

a cam side rocker arm portion configured to selectively rotate about a pivot axis, the cam side rocker arm portion including an inner surface defining a cam side bore;

a valve side rocker arm portion configured to rotate about the pivot axis relative to the cam side rocker arm portion, the valve side rocker arm portion including an inner surface defining a valve side bore; and a latch pin assembly for selectively latching and unlatching the cam side rocker arm portion relative to the valve side rocker arm portion, the latch pin assembly comprising:

a latch pin moveable within the cam side bore and the valve side bore, the latch pin comprising a first portion and a second portion, wherein both an outer surface of the first portion and an outer surface of the second portion of the latch pin are frustoconical-shaped and tapered in the same direction.

2. The rocker arm assembly of claim 1, wherein a step is provided between the outer surfaces of the first portion and the second portion of the latch pin.

3. The rocker arm assembly of claim 1, wherein a ramp is provided between the outer surfaces of the first portion and the second portion of the latch pin.

4. The rocker arm assembly of claim 1, wherein the outer surface of the first portion of the latch pin and/or the outer surface of the second portion of the latch pin is tapered at an angle between about 0.4 degrees and about 3.0 degrees with respect to a longitudinal axis of the latch pin.

5. The rocker arm assembly of claim 1, wherein the outer surface of the first portion has a first diameter that is less than a second diameter of the outer surface of the second portion.

6. The rocker arm assembly of claim 1, wherein, when the latch pin is tilted within the cam side bore and the valve side bore, a surface contact is provided at a location where the outer surface of the first portion of the latch pin engages the valve side bore and a second surface contact is provided at a location where the outer surface of the second portion of the latch pin engages the cam side bore.

7. The rocker arm assembly of claim 1, wherein an inner surface of the cam side bore is cylindrical-shaped.

8. The rocker arm assembly of claim 1, wherein an inner surface of the valve side bore is frustoconical-shaped.

9. A rocker arm assembly comprising:

a cam side rocker arm portion configured to selectively rotate about a pivot axis, the cam side rocker arm portion including a cam side bore;

a valve side rocker arm portion configured to rotate about the pivot axis relative to the cam side rocker arm portion, the valve side rocker arm portion including a valve side bore; and a latch pin assembly for selectively latching and unlatching the cam side rocker arm portion relative to the valve side rocker arm portion, the latch pin assembly comprising:

a latch pin moveable within the cam side bore and the valve side bore, the latch pin having a first portion and a second portion, wherein both an outer surface of the first portion and an outer surface of the second portion are frustoconical-shaped and tapered in the same direction.

10. The rocker arm assembly of claim 9, wherein both the outer surface of the first portion and the outer surface of the second portion are tapered at an angle between about 0.4 degrees and about 3.0 degrees with respect to a longitudinal axis of the latch pin.

11. The rocker arm assembly of claim 9, wherein an inner surface of the cam side bore is cylindrical-shaped.

12. The rocker arm assembly of claim 11, wherein an inner surface of the valve side bore is frustoconical-shaped.

13. The rocker arm assembly of claim 9, wherein when the latch pin is tilted within the cam side bore and the valve side bore, a surface contact is provided at a location where the outer surface of the first portion of the latch pin engages the valve side bore and a second surface contact is provided at a location where the outer surface of the second portion of the latch pin engages the cam side bore.

14. A rocker arm assembly comprising:

a cam side rocker arm portion configured to selectively rotate about a pivot axis, the cam side rocker arm portion comprising a cam end configured to receive a lift profile from a cam lobe, the cam side rocker arm portion including a cam side bore;

a valve side rocker arm portion coupled to the cam side rocker arm portion and configured to rotate about the pivot axis relative to the cam side rocker arm portion, the valve side rocker arm portion including a valve side bore; and a latch pin assembly for selectively latching and unlatching the cam side rocker arm portion relative to the valve side rocker arm portion about the pivot axis, the latch pin assembly comprising:

a latch pin moveable within the cam side bore and the valve side bore, the latch pin comprising a main portion and a reduced portion, wherein both an outer surface of the main portion and an outer surface of the reduced portion of the latch pin are frustoconical-shaped and tapered in the same direction, wherein inner surfaces of the cam side bore and the valve side bore are frustoconical-shaped.

15. The rocker arm assembly of claim 14, wherein the inner surfaces of the cam side bore and the valve side bore are tapered at an angle between about 0.4 degrees and about 3.0 degrees.

16. The rocker arm assembly of claim 14, wherein when the latch pin is tilted within the cam side bore and the valve side bore a surface contact is provided at a location where the outer surface of the reduced portion engages the valve side bore and a second surface contact is provided at a location where the outer surface of the main portion engages the cam side bore.

17. The rocker arm assembly of claim 14, wherein inner surfaces of the cam side bore and the valve side bore are tapered in opposite directions.

* * * * *